United States Patent [19]

Leising et al.

[11] 4,258,648

[45] Mar. 31, 1981

[54] TAPERED DONOR ROLL APPLICATOR FOR ROLL FUSER

[75] Inventors: Walter F. Leising, Webster; Kenneth R. Rasch, Walworth, both of N.Y.

[73] Assignee: Xerox Corporation, Stamford, Conn.

[21] Appl. No.: 891,234

[22] Filed: Mar. 29, 1978

[51] Int. Cl.[3] ..... G03G 15/20

[52] U.S. Cl. ..... 118/60

[58] Field of Search ..... 118/60, 70, 211, 202; 355/3 FU; 432/60; 219/216, 469; 29/122; 427/22; 100/93 RP, 158, 160, 168, 176; 101/329, 330, 331; 401/208, 218

[56] References Cited

U.S. PATENT DOCUMENTS

| | | | |
|---|---|---|---|
| 1,993,284 | 3/1935 | Roehm | 118/259 X |
| 3,032,007 | 5/1962 | McCauliff | 118/259 X |
| 3,918,397 | 11/1975 | Thettu | 118/60 |
| 3,964,431 | 6/1976 | Namiki | 118/60 |
| 4,019,024 | 4/1977 | Namiki | 432/60 |
| 4,045,165 | 8/1977 | Nakajima et al. | 118/60 |
| 4,136,613 | 1/1979 | Namiki | 432/60 |

OTHER PUBLICATIONS

*IBM Technical Disclosure Bulletin,* vol. 14, No. 4, Sep. 1971, "Offset Preventing Materials for Roll Fuser", p. 1159.

*Primary Examiner*—Morris Kaplan

[57] ABSTRACT

A heat and pressure roll fusing apparatus for fixing toner images to copy substrates, the toner comprising a thermoplastic resin. The apparatus includes a heated, either internally or externally, fuser roll cooperating with a backup or pressure roll to form a nip through which the copy substrates pass with the images contacting the heated roll. The heated fuser roll is characterized by an outer layer or surface fabricated from a silicone rubber material to which a low viscosity polymeric release fluid is applied, the silicone rubber being susceptible to swelling in the presence of the release fluid. A release fluid metering system is provided which includes a tapered roll that is adapted to apply release fluid to the entire outer fuser roll surface or to only a portion thereof depending upon the size substrate being utilized.

4 Claims, 2 Drawing Figures

TAPERED DONOR ROLL APPLICATOR FOR ROLL FUSER

BACKGROUND OF THE INVENTION

This invention relates generally to xerographic copying apparatus, and more particularly, it relates to the heat and pressure fixing of particulate thermoplastic toner by direct contact with a heated fusing member having a release fluid applied thereto.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto.

In order to affix or fuse electroscopic toner material onto a support member by heat, it is necessary to elevate the temperature of the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquify and cause a splitting action in the molten toner resulting in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate, such as the solid Teflon outer surface or covering of the aforementioned arrangement.

In attempts to improve at least the perceived quality of the image fused or fixed by a heated roll fuser, such rolls have been provided with conformable surfaces comprising silicone rubber. As in the case of the Teflon coated fuser roll release fluids such as silicone based oils have been applied to the surface of the silicone rubber to both minimize offsetting and to facilitate stripping. See, for example, U.S. Pat. No. 3,964,431. When the fuser system is one which provides for applying silicone oil to silicone rubber, a low viscosity silicone oil (i.e. on the order of 100–1000 cs) has most commonly been employed.

Heretofore, the application of the silicone oil to the silicone rubber fuser roll has been accomplished uniformly by means of a wick or roller member which is coextensive with the longitudinal axis of the fuser roll to which it meters the silicone oil. Thus, it can be seen that a uniform amount of release fluid would be applied to the surface of the fuser roll by conventional metering systems. When the copy substrate dimension normal to the direction of travel of the substrate is less than the total length of the fuser roll the ends of the roll beyond the copy paper (i.e. the portion of the roll surface not contacted by the copy paper) continuously take on oil without removal thereof while the area contacted by the copy paper has some of the oil removed by the copy paper as it moves through the nip between the two roll structures. The foregoing results in the swelling of the ends of the roll to such a degree that paper handling problems occur resulting in wrinkled copies. In practice, it has been observed that the nip length (i.e. the length of the depression in the deformed roll) between the pressure roll and the ends of the fuser roll increase due to the swelling, approximately 5 mils where the original length had been 150 to 170 mils with 300 pounds total force being applied between the fuser and pressure rolls, the outside diameter of the roll being on the order of 2 to 3 inches with an outer layer of silicone rubber having a thickness on the order of 5 to 15 mils.

OBJECTS OF THE INVENTION

Accordingly, the general object of the present invention is to provide an improved heat and pressure roll fusing system for fixing toner images in a xerographic process.

It is a more particular object of this invention to provide, in a heat and pressure fusing system, an improved metering system for applying release material to a silicone rubber fuser roll.

Another object of this invention is to provide an improved heat and pressure roll fusing apparatus employing a release agent metering system having a tapered donor roll for conveying release agent material contained in a sump to the surface of the fuser roll.

Still another object of the present invention is to provide an improved heat and pressure roll fusing apparatus wherein a tapered donor roll is provided for applying release agent material to the surface of the fuser roll, said tapered donor roll having means for varying the contact pressure between it and the fuser roll whereby release agent material can be applied to the entire surface of the fuser roll or to only a portion thereof depending upon the size of the copy substrate being utilized.

Other objects and advantages of the present invention will become apparent when read in conjunction with the accompanying drawings in the specification.

SUMMARY OF THE INVENTION

The above-cited objects are accomplished by the provision of a heat and pressure roll fuser comprising a heated fuser roll having a silicone rubber surface to which a relatively low viscosity (i.e. 100–1000 cs) polymeric release fluid is applied in order to enhance stripping of the copy substrate from the fuser roll. As in a conventional roll fuser apparatus, the silicone rubber surfaced roll cooperates with a pressure roll to form a nip through which the copy paper or substrates pass with the toner images contacting the heated fuser roll.

In order to obviate the problem of roll end swelling, a tapered donor roll is provided for conveying the polymeric fluid from a sump to the surface of the fuser roll. Means for applying a force between the donor roll and the fuser roll is provided and is capable of selective variation of the force between the donor member and the fuser roll. The taper of the donor roll is such that when lower forces are applied only the center portion of the donor roll contacts the fuser roll intermediate the ends thereof. The area of contact corresponds to that which would be contacted by an 11 inch copy paper moving through the nip formed by the fuser roll and the pressure roll. In the foregoing manner, silicone oil is applied only to the area of the silicone rubber surface of the fuser roll which is contacted by the copy paper. Accordingly, oil is not applied beyond the edges of the copy paper to the ends of the roll and thus, the aforementioned swelling of the roll ends with the resulting paper handling problems being minimized.

When a substantially greater force is applied to effect contact between the donor roll and the fuser roll the entire surface of the donor roll may contact the fuser roll thereby applying silicone oil to substantially the entire surface of the fuser roll. The foregoing force is applied when larger than 11 inch paper is being utilized in the xerographic apparatus in which the present fuser is to be employed. Intermediate pressures would also be possible and would be selected in accordance with the dimension of the paper moving through the fuser.

DESCRIPTION OF THE PREFERRED EMBODIMENT OF THE INVENTION

Figure 1:
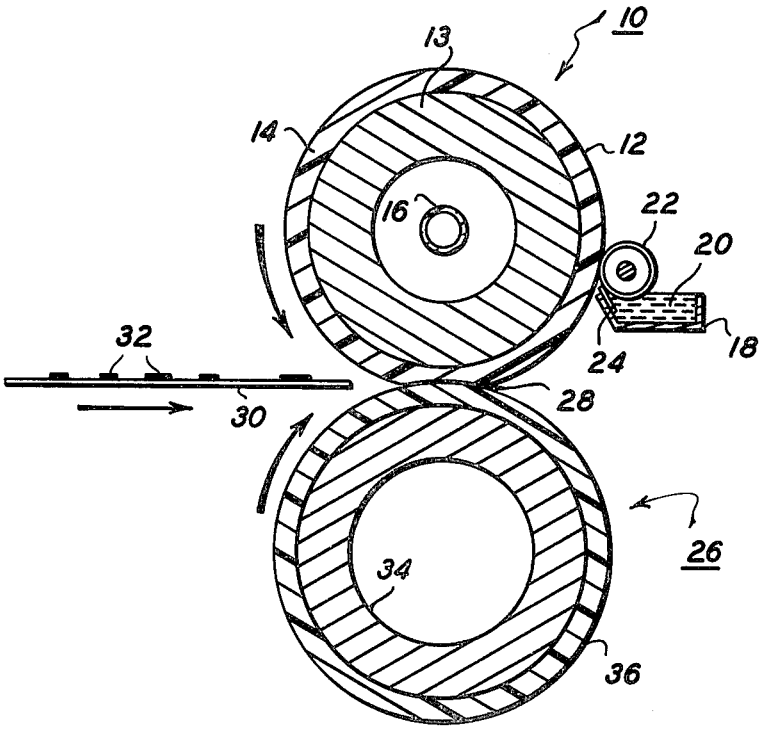
FIG. 1 is a schematic side elevational view of a heat and pressure fuser according to the present invention.

As illustrated in FIG. 1, a heat and pressure roll fuser system 10 according to the present invention is disclosed.

The system comprises a heated fuser member in the form of a roll 12 comprising a rigid core 13 fabricated from any suitable material which by way of example may comprise aluminum, copper or steel, etc. An important feature of the core material is that it be relatively high in thermal conductivity. A coating or layer 14 is adhered to the core to form the outer surface of the roll 12. The coating or layer 14 is preferably fabricated from an adhesive material such as silicone rubber of the type conventionally employed in roll fuser constructions.

A heating element 16, as shown in FIG. 1 is disposed internally of the fuser member and is substantially coextensive with the longitudinal axis of the roll 12. The element 16 may comprise a suitable type heater capable of elevating the surface temperature of the fuser member to toner fusing temperatures which are generally on the order of 250°–400° F. The heating element may, for example, comprise a quartz lamp.

The thickness of the coating 14 is on the order of 5 to 15 mils and can therefore be considered relatively thin.

A sump 18 containing a polymeric release fluid 20 is supported adjacent the fuser member 12 such that a donor roll 22 contacts the release fluid 20 and the surface 14. A metering blade 24 which may be formed integrally with one end of the sump 18 contacts the surface of the donor roll 22 to thereby meter a substantially uniform thickness of release material to the surface of the donor roll 22. Typical materials employed for the donor roll comprise copper, stainless steel, and steel with the latter two being preferred over the copper. The metering blade 24 is preferably fabricated from Viton (a trademark of E. I. duPont) which is substantially impervious to the type of fluid utilized, such fluids commonly employed being silicone oil.

Typical materials utilized as release fluids are low viscosity (i.e. 100–1000 cs.) silicone based oils, one such fluid being available from Dow-Corning and designated D. C. 200 dimethyl silicone oil and functional silicone oils of the type disclosed in U.S. application Ser. Nos. 491,432, now abandoned and 491,412, now U.S. Pat. No. 4,029,827, filed July 24, 1974 and assigned to the same assignee as the instant application.

The fuser system 10, in addition to the fuser roll 12 comprises a pressure or backup roll 26 which cooperates with the fuser roll when force is applied in a well known manner between the rolls, to form a nip 28 through which a copy substrate 30 having toner images 32 electrostatically adhered thereto passes with the toner images contacting the release agent coated silicone rubber surface 14. The pressure roll comprises a rigid core 34 to which a relatively thin layer 36 of abhesive material is applied, such material for example, comprising polytetrafluoroethylene. The rolls 12 and 26 typically have a nominal diameter on the order of 2 to 3 inches and a length of approximately 15 inches. The roll 26 is harder than the roll 12, thus, when pressure is applied therebetween the fuser roll deforms to form the nip 28.

The material forming the toner images may comprise various types of thermoplastic resins containing a dye or pigment. Typical materials comprise conventional non-reactive toners for example, carbon black pigmented copolymer of styrene-n-butylmethacrylate as described in U.S. Pat. No. 3,079,342 and incorporated herein by reference.

They may also comprise reactive toners of the type comprising a colorant, a solid stable hydrophobic metal salt of a fatty acid and a polymeric esterification product of dicarboxilic acid and a diol comprising a dyphenol as exemplified and prepared in Example II of U.S. Pat. No. 3,590,000 and incorporated herein by reference.

While not specifically shown, the pressure roll 26 may be pivotably supported for movement between a fuser roll engaging position and a non-engaging position. Such movement as will be appreciated is effected in a predetermined sequence in accordance with the cycle of operation of the xerographic reproducing apparatus in which the use of the fuser is contemplated. Accordingly, prior to a copy substrate reaching the fuser station, engagement is effected. During a standby mode when copies are not being reproduced the rolls are separated or disengaged. Typical pressures exerted between the fuser roll and pressure roll are on the order of 300 pounds total pressure which for a 15 inch long roll would be 20 pounds per linear inch.

Figure 2:
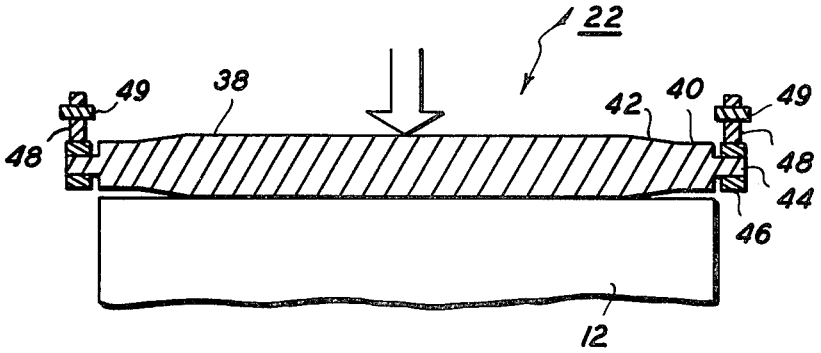
FIG. 2 is a schematic plan view of a tapered donor roll forming a part of the heat and pressure fuser of FIG. 1 and the fuser roll to which it applies the release fluid.

The donor roll 22 is disclosed in greater detail in FIG. 2 of the drawings. While not strictly limited to an overall length of 15 inches the donor roll disclosed in FIG. 2 is considered to be 15 inches long for purposes of disclosure of the preferred embodiment. The roll 22 has a central non-tapered portion 38 which is approximately 10 inches in length. The donor roll has a pair of non-tapered end portions 40 which are connected to the area 38 by tapered portions 42. Each end portion is approximately 1 inch in length. The diameter of the end portions 40 is approximately 5 mils less than the diameter of the central area 38 which is approximately 1 inch. A pair of donor roll support shafts 44 are supported by bearings 46 such that the donor roll 22 is supported for rotation, such rotation being effected through its engagement with fuser roll 12.

Means for effecting pressure engagement between the donor roll 22 and the fuser roll 12 are provided. Such means may comprise any conventional mechanism for applying pressure such as cams 48 supported by shafts 49 as shown schematically in FIG. 2. The mounting of the roll 22 is such that a normal pressure of approximately 20 pounds total pressure is effected between the donor roll and the fuser roll. The force varying mechanism 48 preferably increases the pressure to approximately 40 pounds total pressure therebetween. Obviously, other pressures and force varying mechanisms may be employed without departing from the spirit of the invention. As can be seen from reference to FIG. 2, when the normal force is applied between the donor roll and the fuser roll only the central area of the donor roll contacts the fuser roll. Accordingly, only that area contacted and immediately adjacent areas will have the release agent material applied thereto. Thus, when copy paper is utilized which is 11 inches wide, the donor roll does not apply oil to the areas of the fuser beyond the central area 38. However, by employing the force increasing mechanism 48 oil can be applied to the entire surface of the fuser roll 12.

While the invention has been disclosed in conjunction with the preferred embodiment thereof it will be appreciated by those skilled in the art that other modifications can be made without departing from the spirit and scope of the invention. Accordingly, it is intended that the invention be limited only by the scope of the claims appended hereto.

What is claimed is:

1. Roll fuser apparatus comprising:

a first roll fuser member having a silicone rubber surface thereon which surface is susceptible to swelling in the presence of liquid release material;

a second roll fuser member cooperating with said first roll fuser member to form a nip through which copy substrates carrying toner images thereon move for fixing of the toner images to said substrates;

means containing a quantity of silicone oil; and means supported for contact by said silicone oil and for contacting substantially the entire surface of said silicone rubber surface while alternatively being capable of adjustment for contacting only a portion of said surface.

2. Apparatus according to claim 1 wherein said last mentioned means comprises a tapered donor roll immersed in a sump containing said silicone oil and supported for rolling contact with one of said roll fuser members, said tapered donor roll having a length substantially equal to the length of said one of said roll fuser members.

3. Apparatus according to claim 2 including means for internally heating said one of said roll fuser members.

4. Apparatus according to claim 3 wherein the adjustment means includes means for varying the contact force between said tapered donor roll and said one of said roll fuser members whereby only a portion of said donor roll surface is adapted to contact the surface of said one of said roll fuser members or all of said tapered donor roll is adapted to contact the surface of said one of said roll fuser members depending on the pressure exerted therebetween.

* * * * *